US006178848B1

(12) United States Patent
Lowe

(10) Patent No.: US 6,178,848 B1
(45) Date of Patent: Jan. 30, 2001

(54) HOOK RETENTION IN TUBULAR JACK HANDLE

(75) Inventor: Frank Lowe, Maysville, KY (US)

(73) Assignee: Wald LLC, Maysville, KY (US)

( * ) Notice: Under 35 U.S.C. 154(b), the term of this patent shall be extended for 0 days.

(21) Appl. No.: 09/261,784

(22) Filed: Mar. 3, 1999

Related U.S. Application Data

(60) Provisional application No. 60/076,731, filed on Mar. 4, 1998.

(51) Int. Cl.[7] ..... G05G 1/12; B25G 3/02
(52) U.S. Cl. ..... 74/544; 74/548
(58) Field of Search ..... 74/544, 524, 548, 74/543, 546, 547

(56) References Cited

U.S. PATENT DOCUMENTS 1,108,212 * 8/1914 Nelson ..... 74/548
5,878,627 * 3/1999 McMurtrey ..... 74/544

* cited by examiner

*Primary Examiner*—Mary Ann Green
(74) *Attorney, Agent, or Firm*—Wood, Herron & Evans, LLP

(57) ABSTRACT

A hook and jack handle assembly in which the hook is retained within the tubular jack handle during use of the assembly in operating a vehicle jack. To this end, a tubular end portion in a jack handle has inserted therein a hook-shaped end piece having a pre-formed indentation. The tubular wall of the jack handle is displaced within the pre-formed indentation such that the end piece is prevented from slipping out of the jack handle during use.

19 Claims, 1 Drawing Sheet

HOOK RETENTION IN TUBULAR JACK HANDLE

Pursuant to 37 C.F.R. § 1.78(a)(4), this application claims the benefit of and priority to prior filed co-pending Provisional Application Ser. No. 60/076,731, filed Mar. 4, 1998, which is expressly incorporated herein by reference.

BACKGROUND OF THE INVENTION

This invention relates to vehicle jacks and, more particularly, to an improved handle for actuating such jacks.

Motor vehicles have traditionally been equipped with a spare wheel to use in the event that one of the tires became flat or disinflated. Along with a spare wheel, some means for raising the vehicle in order to change the wheel must be provided. This means of lifting the vehicle has usually been some form of vehicle jack.

Some vehicle jacks have heretofore been designed to be positioned underneath the vehicle, usually just to the inside of the tire to be changed and the designated lifting point is generally the axle or other nearby wheel support structure. These jacks may be either of a scissors-type or a telescoping-type and normally utilize a screw drive. In both cases, a rotary force is applied to an operator or coupling on the end of a screw drive to either raise or lower the vehicle depending upon whether the rotary motion is clockwise or counterclockwise.

To impart that rotary motion to the jack, a handle is attached to the jack spindle both, to transmit the rotary motion to the jack and, to help position the jack at the proper lifting location underneath the vehicle. The jack handle must be long enough to reach from the perimeter of the vehicle to the jack which is positioned underneath the vehicle while still allowing enough room for the operator to apply the rotary motion to the end of the handle remote from the jack.

Some of the current jack handles on the market have a solid metal end with a generally L-shaped tip or hook on one end of the jack handle. This hook is engaged with an operator on the base of the jack which allows the jack handle to be used to push and pull the jack to position it underneath the vehicle. Furthermore, the hook drivingly engages the jack operating coupling and transmits the necessary rotary motion and torque from the jack handle to the jack screw in order to lift the vehicle.

Referring to FIG. 1, to manufacture the hook and jack handle assembly, a hook 14 is formed in a first end 13 of a solid metal end piece 12 which has an opposite end 18 with a noncircular cross-section. The opposite end 18 of the end piece 12 is inserted into a tubular section 20 of the jack handle 22 and then held in place while a stake or crimp (not shown) is applied to the outer surface of the tubular section 20. In theory, the crimp should simultaneously form mating depressions in both the tubing wall 16 and opposite end 18 of the end piece 12, which should secure the end piece 12 to the end of the jack handle 22 and prevent the end piece 12 from separating from the jack handle 22 during normal use.

In practice, however, often, this is not what happens. As the crimp punch displaces the material in the tubing wall 16, the tubing wall material is merely compressed and thinned out to form a notch 26 between the crimp punch and the end piece 12, as shown in FIG. 1. The tubing wall does not displace the adjoining material in the end piece 12 as one would expect. If the crimping force is increased with the intent of causing the punch to penetrate into the end piece material, the tubing wall 16 is often punched through as shown at notch 28 in FIG. 2. Alternatively, only an extremely thin section of tube wall 16 is left in the depression formed in the end piece 12, which will not adequately retain the end piece 12 in the jack handle 22 when forces such as an axial load are applied to the hook and jack handle assembly.

In order to meet the torque requirements placed on the hook and jack handle assembly, the tensile strength of the end piece 12 is greater than the tensile strength of the tubular section 20 of the jack handle 22. This would account for the softer tubing wall 16 not being able to displace the harder end piece material. Also the thin tubing wall 16 presents a much less substantial structure than the solid end piece 12. Thus, the tubing wall 16 is simply displaced by the punch instead of being able to work the material of the end piece 12.

As a result of the tubing wall 16 not displacing the material in the end piece 12, the minimal contact between the end piece 12 and tubing wall 16 at the crimp area creates a frictional force that temporarily holds the end piece 12 in place within the jack handle 22. Once the jack handle is used, however, the forces applied to the hook 14 and jack handle 22 can cause the tubular section 20 to relax slightly, that is, to deflect or move, and the contact between the tubular section 20 and end piece 12 is lost. The end piece 12 with hook 14 can then be easily dislodged from the jack handle 22 when longitudinal forces apply an axial load, such as when the hook and jack handle assembly is used to pull the jack (not shown) from underneath the vehicle.

There is thus a need to provide a hook and jack handle assembly in which the hook will not unexpectedly separate from the jack handle during normal use of the vehicle jack.

SUMMARY OF THE INVENTION

The present invention provides a hook and jack handle assembly for use in operating vehicle jacks in which the hook is permanently retained within the tubular end portion of the jack handle such that the jack handle assembly operates more reliably over the useful life of the jack. To this end and in accordance with the principles of the present invention, there is provided an end piece with a hook at one end and a pre-formed notch or depression in the other end for inserting into the end of a tubular jack handle to form a hook and jack handle assembly for operating a vehicle jack. Upon crimping the tubular wall of the jack handle, the punch engages the tube wall and forms a crimp or indentation within and/or forced into contact with the pre-formed notch in the end piece. This results in a substantial thickness of the tubing wall being depressed into the notch in the end piece such as to prevent the end piece from being removed and not subject to being separated from the jack handle during its normal use. Thus, the jack handle assembly of the present invention has the advantages of being easier to use and more reliable over the life of the assembly.

DETAILED DESCRIPTION OF THE INVENTION

Figures 1, 2, 3, 4, 5:
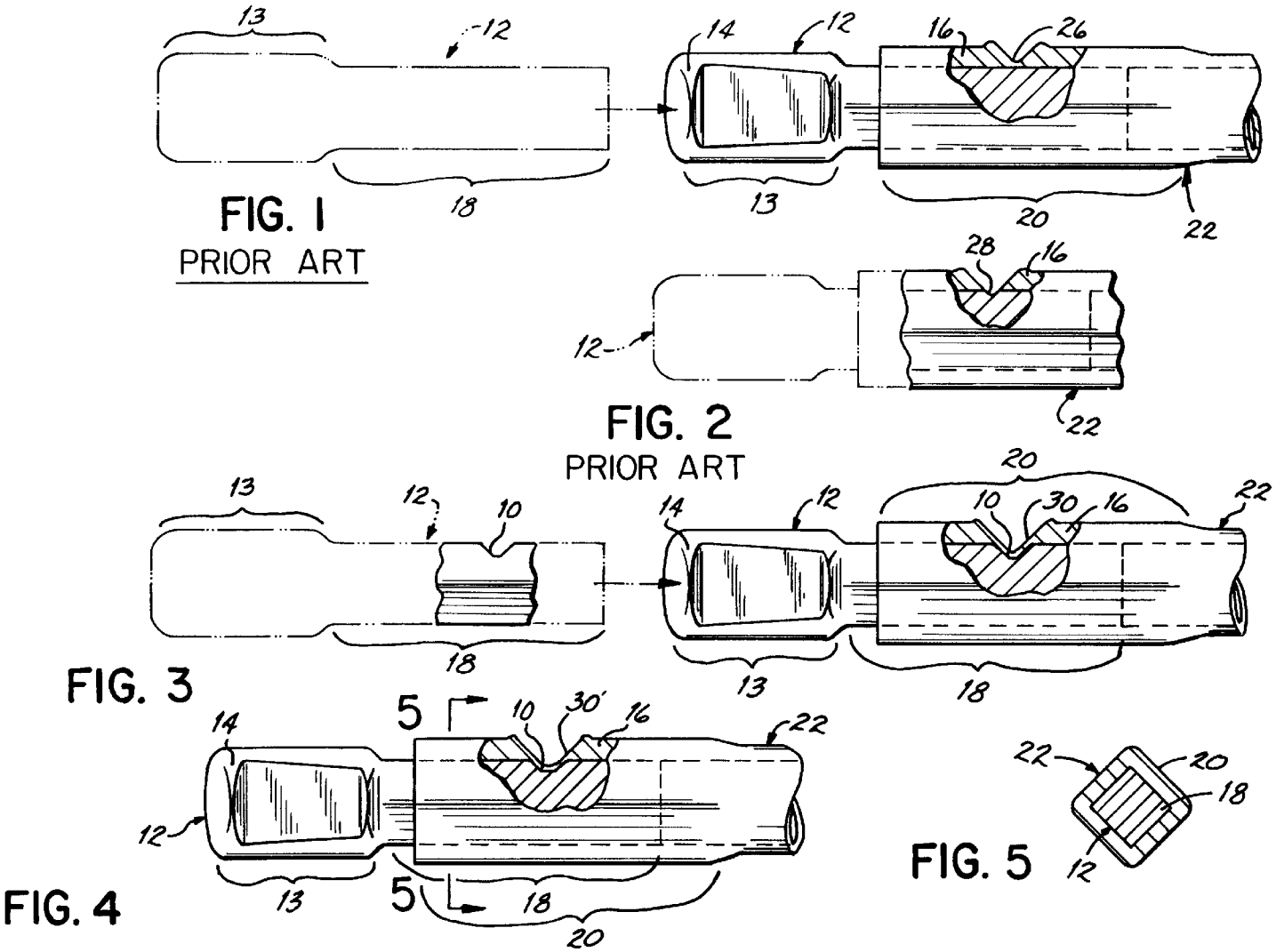
FIG. 1 PRIOR ART
FIG. 2 PRIOR ART
FIG. 1 is a partial side view of a hook and jack handle assembly in the prior art, partially broken away to show the effect of crimping.
FIG. 2 is a partial side view of a hook and jack handle assembly in the prior art, partially broken away to show the effect of crimping with a greater degree of crimp punch penetration than that in FIG. 1.
FIG. 3 is a partial side view of a pre-notched end piece of a hook and jack handle assembly in accordance with the principles of the present invention which is partially broken away to further show the effect of crimping with a square-end punch.
FIG. 4 is a partial side view of a pre-notched end piece of a hook and jack handle assembly in accordance with the principles of the present invention which is partially broken away to further show the effect of crimping with a round-end punch.
FIG. 5 is a cross-sectional view taken along the 5—5 line of FIG. 4.

As shown in FIGS. 3 and 4, the present invention overcomes the problem of the end piece not deforming during crimping, which results in failure of the hook and jack handle assembly under an axial load, by preforming a notch or depression 10 in the solid metal end piece 12 prior to its assembly with a jack handle 22. The first end 13 of end piece 12 has a formed tip, for example, a generally L-shaped tip, such that first end 13 forms a hook 14 , that is adapted to engage and transmit rotary motion from the end piece 12 to a rotatable coupling (not shown) in a vehicle lifting jack (not shown). The opposite end 18 of end piece 12 has a noncircular cross-sectional profile for insertion into a tubular section 20 at one end of jack handle 22 to form a hook and jack handle assembly. The notch 10 is formed into the opposite end 18 of end piece 12. Tubular section 20 of jack handle 22 and the opposite end 18 of end piece 12 have a noncircular cross-section, such as shown in FIG. 5.

After inserting opposite end 18 having the notch 10 into tubular section 20, a crimp punch (not shown) then engages the tubing wall 16 in the tubular section 20 of jack handle 22 to displace a substantial thickness of the tubing wall material and to form a crimp or indentation 30, 30' within the pre-formed notch 10 in the end piece 12. As would be apparent to one skilled in the art, the extent to which the tubing wall 16 contacts one or both sidewalls and the bottom of the pre-formed notch 10 may vary depending on a number of manufacturing factors, including the depth of the pre-formed notch 10, the particular tooling used to crimp the tubing wall 16, and the force used for crimping. Full contact between the tubing wall 16 and the walls of the pre-formed notch 10 to form mating depressions is preferred to provide superior hook retention. It will be appreciated, however, that less than full contact with the notch walls or no contact at all within the pre-formed notch 10 may occur due to the particular manufacturing route and tooling employed, yet still provide retention of the end piece 12 in the jack handle 22 during its normal use in accordance with the principles of the present invention.

The crimp punch may be a square-end punch, that is, a punch with V-shaped sides that terminate with a flat end normal to the centerline of the punch. A square-end punch was used to form crimp 30 in FIG. 3. Alternatively, a round-end punch may be used, such as that used to form crimp 30' in FIG. 4. A round-end punch has tapering V-shaped sides that terminate with a radiused end or arc that blends into the sides. A crimp punch of any other suitable end shape may also be used. Better results are obtained using the round-end punch for crimping tubing wall 16 because the rounded edges allow more working of the tubing material without cutting or thinning the tubing walls. The same types of punches described for use in crimping the tubing wall 16 may also be used to form the pre-formed notch 10. For example, a square-end punch was used to form the notch 10 in FIGS. 3 and 4. The notch 10 formed in the end piece 12 need not be of the same shape as the crimp 30' formed in the tubing wall 16, as shown in FIG. 4.

The jack handles and end pieces or hooks used in the assembly of the present invention may be of varied shapes and sizes. The preferred embodiment consists of a non-circular end section of the jack handle with a non-circular cavity therethrough, such as a square or rectangular cavity, and a non-circular solid end piece. For example, FIG. 5 depicts a cross section taken along line 5—5 in FIG. 4 showing a square tubular section 20 with a square cavity filled by a square end piece 12.

In use, hook 14 of the jack handle assembly is engaged with an operator or coupling on the end of a screw drive at the base of the vehicle jack, and a longitudinal force is applied to the jack handle 22 to push the jack underneath the vehicle. Once positioned at a proper lifting point, rotary force in one direction is applied to the jack handle 22 so as to impart the necessary rotary motion and torque to the screw drive to raise the vehicle. After the vehicle tire has been changed, a rotary force in the opposite direction is applied to lower the vehicle, and the jack handle 22 with hook 14 is used to pull the jack out from under the vehicle. During this procedure, the hook 14 on end piece 12 is securely retained within jack handle 22. This procedure may be repeated again and again over the life of the jack, and the hook 14 will remain permanently retained with jack handle 22 due to the tubular wall 16 being locked into the pre-formed notch 10.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the end piece and cavity within the tubular section may be of any shape, such as square, rectangular, triangular, etc. Furthermore, the remainder of the jack handle may be of any material or shape.

In the present invention, the tubular end of the jack handle is formed from the same tubular material used for the remainder of the jack handle. However, as will be appreciated, the tubular section may be made from square or hex stock and welded onto the end of the jack handle. The hook end piece may be secured to the tubular end section of the jack handle by any number of known crimping or staking processes.

Therefore, the invention in its broadest aspects is not limited to the specific details shown and described. Consequently, departures may be made from the details described herein without departing from the spirit and scope of the claims which follow.

What is claimed is:

1. A jack handle assembly for use with a vehicle jack comprised of a solid metal end piece having a pre-formed indentation in a portion thereof, said indentation having side walls transverse to a length of the end piece, said portion of the end piece being disposed within a tubular section of a jack handle, and a crimp of a substantial amount of material of the tubular section being displaced into and retained by the pre-formed indentation in the solid metal end piece to prevent the end piece from being slidably disengaged lengthwise from the jack handle.

2. The jack handle assembly of claim 1, wherein the crimp is in full contact with the solid metal end piece within the pre-formed indentation.

3. The jack handle assembly of claim 1, wherein said portion of the end piece has a non-circular cross-sectional profile.

4. The jack handle assembly of claim 3, wherein the tubular section has a non-circular cross-sectional profile matching and receiving the cross-sectional profile of the portion of the end piece.

5. A jack handle assembly for use with a vehicle jack comprising:

a solid metal endpiece having a pre-formed indentation in a portion thereof, said indentation having side walls transverse to a length of the end piece;

a jack handle having a tubular section at one end for receiving the portion of the endpiece, and a crimp of a substantial amount of material of the tubular section being displaced into and retained by the pre-formed indentation in the endpiece to prevent a lengthwise separation of the endpiece from the jack handle.

6. A jack handle assembly for use with a vehicle jack comprised of:

a solid metal end piece having a first portion formed adapted to engage with a vehicle jack, and an opposite portion having a pre-formed indentation therein, said indentation having side walls transverse to a length of the end piece; and a jack handle having a tubular section at one end partially receiving the opposite portion of the solid metal end piece including the pre-formed indentation, and a substantial amount of material of the tubular section being displaced within and retained by the pre-formed indentation in the opposite portion of the solid metal end piece, wherein the end piece is prevented from being slidably disengaged lengthwise from the tubular section.

7. The jack handle assembly of claim 6, wherein the shape of the displaced amount of material of the tubular section is substantially similar to the shape of the pre-formed indentation.

8. The jack handle assembly of claim 7, wherein the displaced amount of material of the tubular section is in contact with the solid metal end piece within the pre-formed indentation.

9. The jack handle assembly of claim 6, wherein the shape of the displaced amount of material of the tubular section is different than the shape of the pre-formed indentation.

10. The jack handle assembly of claim 9, wherein the displaced amount of material of the tubular section is in contact with the solid metal end piece within the pre-formed indentation.

11. The jack handle assembly of claim 6, wherein said opposite portion of the end piece has a non-circular cross-sectional profile.

12. The jack handle assembly of claim 11, wherein the tubular section has a non-circular cross-sectional profile matching and receiving the cross-sectional profile of the opposite portion of the end piece.

13. A handle assembly for use in positioning a vehicle lifting jack beneath a vehicle and for rotating a spindle of the jack, the handle assembly comprising:

an end piece having a first end with a formed tip adapted to engage and transmit rotary motion from the end piece to the rotatable spindle of the vehicle lifting jack, and an opposite end with a noncircular cross-sectional profile, the opposite end further including a pre-formed indentation, said indentation having side walls transverse to a length of the end piece; and a jack handle having one end formed with a tubular section receiving the noncircular cross-section of the opposite end of the end piece in driving engagement such that rotation of the jack handle is operable to effect rotation of the end piece, the tubular section having a substantial amount of material disposed within and retained by the pre-formed indentation of the opposite end of the end piece, wherein the end piece is prevented from being slidably disengaged lengthwise from the tubular section.

14. The handle assembly of claim 13, wherein the formed tip is a generally L-shaped hook.

15. The handle assembly of claim 13, wherein the pre-formed indentation has V-shaped side walls terminating in a flat end.

16. The handle assembly of claim 15, wherein the disposed amount of material of the tubular section has V-shaped sides terminating in a flat end.

17. The handle assembly of claim 16, wherein the flat end of the disposed amount of material is in contact with the flat end of the pre-formed indentation.

18. The handle assembly of claim 15, wherein the disposed amount of material of the tubular section has V-shaped sides terminating in a rounded end.

19. The handle assembly of claim 18, wherein the rounded end of the disposed amount of material is in contact with the flat end of the pre-formed indentation.

* * * * *